US008678363B2

(12) United States Patent
Baker

(10) Patent No.: US 8,678,363 B2
(45) Date of Patent: Mar. 25, 2014

(54) MULTIPLE VISE SYSTEM

(76) Inventor: Christopher E. Baker, Chula Vista, CA (US)

( * ) Notice: Subject to any disclaimer, the term of this patent is extended or adjusted under 35 U.S.C. 154(b) by 325 days.

(21) Appl. No.: 13/231,835

(22) Filed: Sep. 13, 2011

(65) Prior Publication Data

US 2012/0068394 A1 Mar. 22, 2012

Related U.S. Application Data

(60) Provisional application No. 61/383,551, filed on Sep. 16, 2010.

(51) Int. Cl.
*B25B 1/20* (2006.01)

(52) U.S. Cl.
USPC ..... 269/45; 269/43; 269/44

(58) Field of Classification Search
USPC ..... 269/71, 43, 44, 45, 75, 73, 104, 271, 269/76, 37, 105, 109, 152, 84; 29/281.1
See application file for complete search history.

(56) References Cited

U.S. PATENT DOCUMENTS

| | | | | |
|---|---|---|---|---|
| 4,434,693 | A * | 3/1984 | Hosoi et al. | 83/76.9 |
| 4,529,183 | A | 7/1985 | Krason et al. | |
| 4,685,663 | A | 8/1987 | Jorgensen | |
| 4,828,241 | A * | 5/1989 | Yang | 269/114 |
| 5,022,636 | A | 6/1991 | Swann | |
| 5,098,073 | A | 3/1992 | Lenz | |
| 5,374,040 | A | 12/1994 | Lin | |
| 5,458,321 | A | 10/1995 | Durfee, Jr. | |
| 5,623,757 | A | 4/1997 | Durfee, Jr. | |
| 5,649,694 | A | 7/1997 | Buck | |
| 5,762,326 | A * | 6/1998 | Swann | 269/43 |
| 6,012,712 | A | 1/2000 | Bernstein | |
| 6,250,620 | B1 | 6/2001 | Durfec, Jr. | |
| 6,338,477 | B1 | 1/2002 | Moore | |
| 6,896,249 | B1 | 5/2005 | Ferrara | |
| 7,163,201 | B2 | 1/2007 | Bernstein | |
| 2006/0049566 | A1 | 3/2006 | Bernstein | |
| 2010/0164185 | A1 * | 7/2010 | Unseld et al. | 277/596 |

* cited by examiner

*Primary Examiner* — Lee D Wilson
*Assistant Examiner* — Nirvana Deonauth
(74) *Attorney, Agent, or Firm* — George S. Levy

(57) ABSTRACT

A multiple vise system comprising at least two vise heads, each vise head comprising two jaws and a tightening screw and also comprising a supporting structure. The supporting structure is configured to support each vise head and allows the position of the vise heads to be adjusted according to at least two degrees of freedom with respect to each other. Position adjustment is achieved by means of track and slots mechanisms, swivels and telescoping poles. A number of secondary clamps are included to hold specially shaped objects such as printed circuit boards and to hold objects too large to be held by a vise head.

12 Claims, 6 Drawing Sheets

MULTIPLE VISE SYSTEM

This invention claims the benefit of U.S. Provisional Application No. 61/383,551 titled "Multiple Vise System" filed on Sep. 16, 2010 which is hereby incorporated by reference. Applicant claims priority pursuant to 35 U.S.C. Par 119(e)(i). This invention relates to devices for holding objects such as multiple vises and clamps that can hold several objects simultaneously, or that can hold a single object at several support points.

FIELD OF THE INVENTION

Background

Vises are well known devices for holding pieces being worked on. Typically they are designed to hold a single object at one single point. A number of patents describe dual vise systems wherein the jaws are mounted on a single vise or slide on a single track. These include U.S. Pat. Nos. 5,623,757 and 6,250,620 by Durfee, U.S. Pat. No. 5,022,636 by Swann, U.S. Pat. No. 4,685,663 by Jorgensen, U.S. Pat. No. 4,529,183 by Krason et al., U.S. Pat. No. 6,896,249 by Ferrara, U.S. Pat. No. 5,374,040 by Lin, U.S. Pat. No. 5,649,694 by Buck as well as U.S. patent application 20060049566 by Bernstein.

U.S. Pat. No. 6,338,477 by Moore includes a single vise head and two screws.

These systems however, lack flexibility and are not adequate when several objects need to be held in a certain spatial relationship with each other or when a single object having a complicated shape needs to be held at more than one point. In addition, when one end of an object is clamped in a vise and cut, the object often breaks off before the cut is completed, leaving two jagged edges rather than the desired smooth, clean cut.

None of the prior art offers the utility value of this invention. Further features, aspects, and advantages of the present invention over the prior art will be more fully understood when considered with respect to the following detailed description claims and accompanying drawings.

SUMMARY OF THE INVENTION

Figure 1:
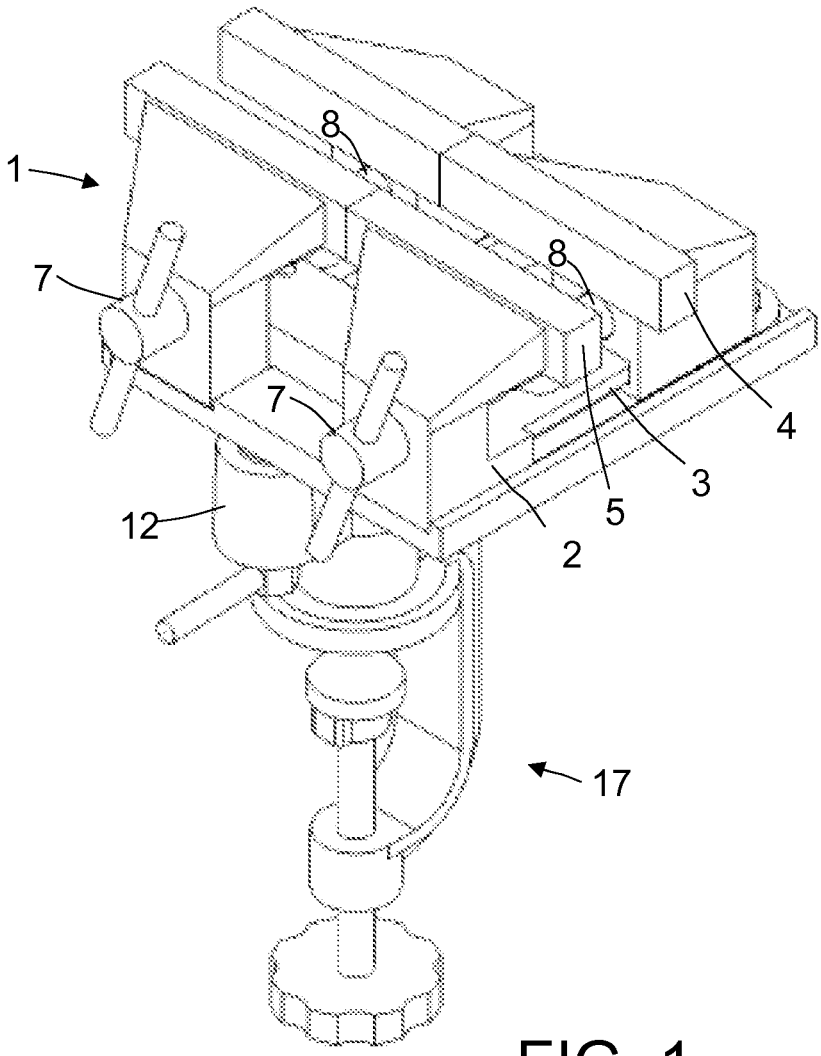
FIG. 1 illustrates a version of the invention comprising two vises capable of being positioned with two degrees of freedom from each other.

This invention provides its user with two features that conventional vises do not have:

a) Two or more support points for the piece being worked on, each support point being provided by an independent vise head, each vise head comprised of two jaws and a tightening screw; and b) A supporting structure for the vise head that allows the adjustment of their positions according to several degrees of freedom thereby providing unprecedented flexibility in configuration for supporting objects being worked on.

The invention comprises a multiplicity of vise heads, each vise head being attached to a common supporting platform configured to allow the position of the vise heads to be adjusted with respect to each other. The relative positions of the vise heads can vary by at lease two degrees of freedom.

In a first implementation, the supporting platform comprises two perpendicular slots that allow the vise heads to be positioned according to two linear degrees of freedom. As an option the vise heads can be rotated with respect to the supporting structure, thereby providing two additional degrees of freedom of the rotational (yaw) type.

In a second implementation, a swivel and a telescoping pole are included in the attachment between each vise head and the supporting platform. Each swivel adds two more rotational degrees of freedom (pitch and roll) and each telescoping pole adds a translational degree of freedom (elevation).

A third implementation includes three vise heads and a supporting platform equipped with three slots oriented at 120 degrees from each other, thereby allowing an object to be supported at three points or two to three objects to be supported in various positions and orientations with respect to each other.

The vise heads are also used in conjunction with secondary clamps designed to hold specially shaped objects such as printed circuit boards or to hold large objects too large to fit within the vise head.

DETAILED DESCRIPTION

This invention provides its user with the following features:

a) Two or more support points for the piece being worked on or cut, each support point being provided by an independent vise head, each vise head comprised of two jaws and a tightening screw; and b) A supporting structure for the vise head that allows the vise heads to be positioned according to several degrees of freedom thereby providing unprecedented configuration flexibility for supporting objects being worked on.

The invention can take many forms. The particular version shown in FIG. 1 includes two vise heads 1 and a supporting platform 9 that allows the vise heads 1 to be moved and firmly positioned along two degrees of freedom with respect to each other. The relative translation of the vise heads in the XY plane is accomplished by the supporting platform 9.

The vise heads 1 are conventional: they include a base 2 and two jaws 4 and 5. Each vise base 2 is equipped with a track or rail 3. The first jaw 4 is firmly attached to the base 2 and the second jaw 5 is configured to slide on the rail 3. A tightening axle 7 traverses both jaws 4 and 5. The axle 7 is free to rotate with respect the first jaw 4 but not to slide in or out of it. The axle 7 is also configured as a screw 8 at one of its ends which is threadedly engaged with the second jaw 5. Turning the screw moves the second jaw 5 closer to, or further away from, the first jaw 4 thereby allowing the jaws to tighten around, or to release, objects.

Figure 2:
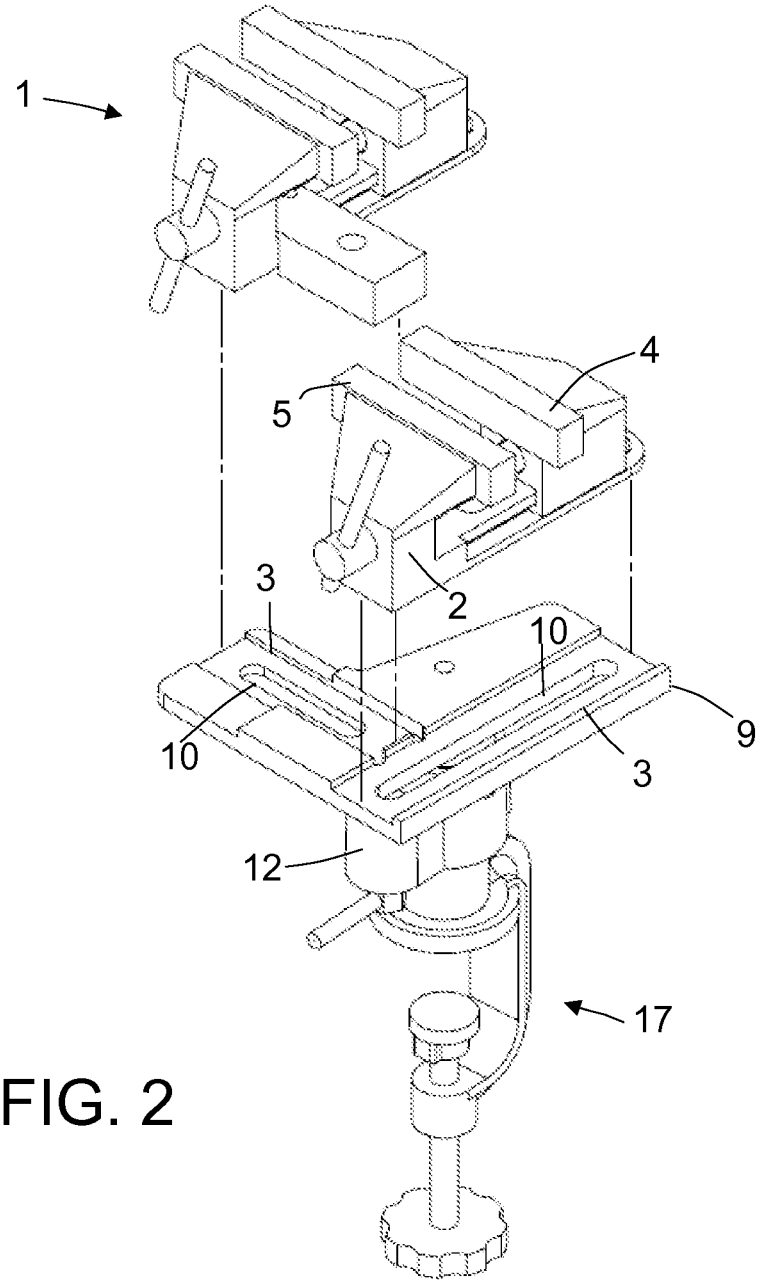
FIG. 2 provides an exploded view of FIG. 1 showing the supporting platform with two slots perpendicular to each other.

Each vise head 1 is supported by a positioning platform 9. The platform comprises two slots 10 oriented at 90 degrees from each other, each slot 10 assigned to a vise head 1. Each vise base 2 is equipped at its bottom with an anchor 11 inserted into the corresponding slots 10. The anchor 11 allows the vise head 1 to slide along the slot 10 thereby allowing the user to position the vise heads 1 with two degrees of freedom (XY) with respect to each other. Anchors 11 are also equipped with tightening screws 12 to allow the firm attachment of the vise head 1 to the positioning platform 9. FIG. 2 provides an exploded view of the invention depicted in FIG. 1 to show clearly the slots 10 and the rails 3 allowing the vise heads to be positioned with respect to each other.

The positioning platform 9 is equipped on its underside with a mounting clamp 17 that allows it to be mounted on a work bench.

Figure 3:
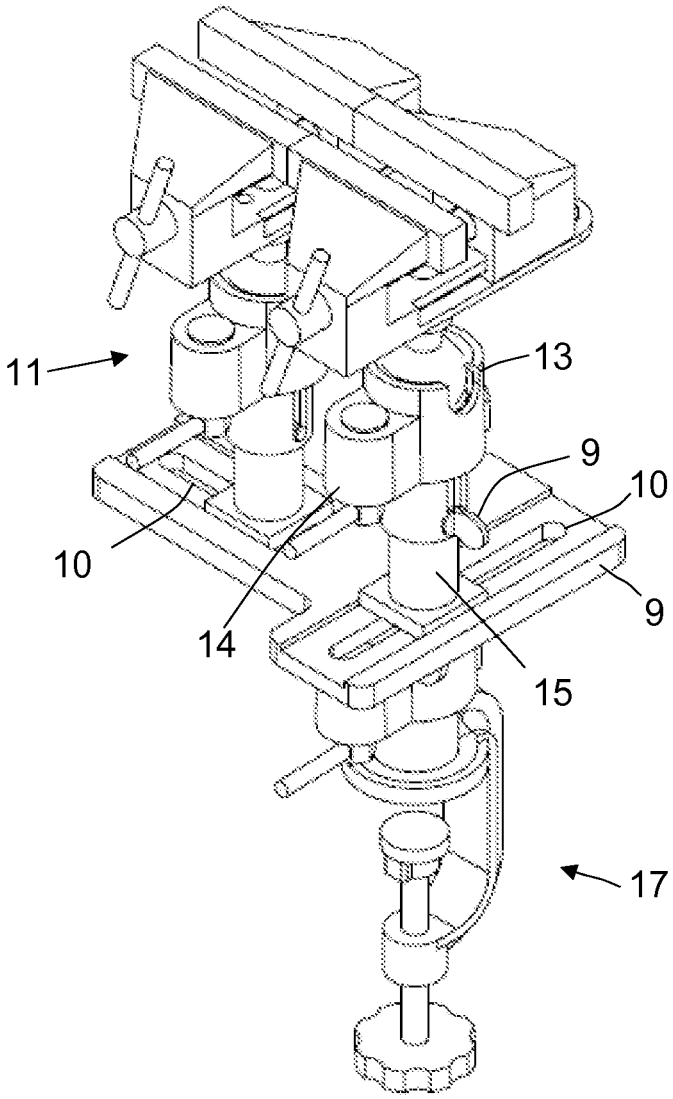
FIG. 3 illustrates a two-vise system wherein the vises are equipped with swivels and height adjustment telescoping poles.

Another version of this invention is shown in FIG. 3. In this version, the vise heads 1 are provided with a larger number of degrees of freedom than in the FIG. 1 version. The anchors 11 used in attaching the vise heads 1 to the positioning platform 9 include a swivel 13 and a telescoping pole 15 that add three rotational degrees of freedom and one translational degree of freedom to each vise head 1. The swivels 13 are each equipped with tightening screws 14 to fix the vise heads 1 in the desired orientation. The telescoping poles 15 are also equipped with tightening screws 16 to adjust the vise head 1 to the desired height.

Figure 4:
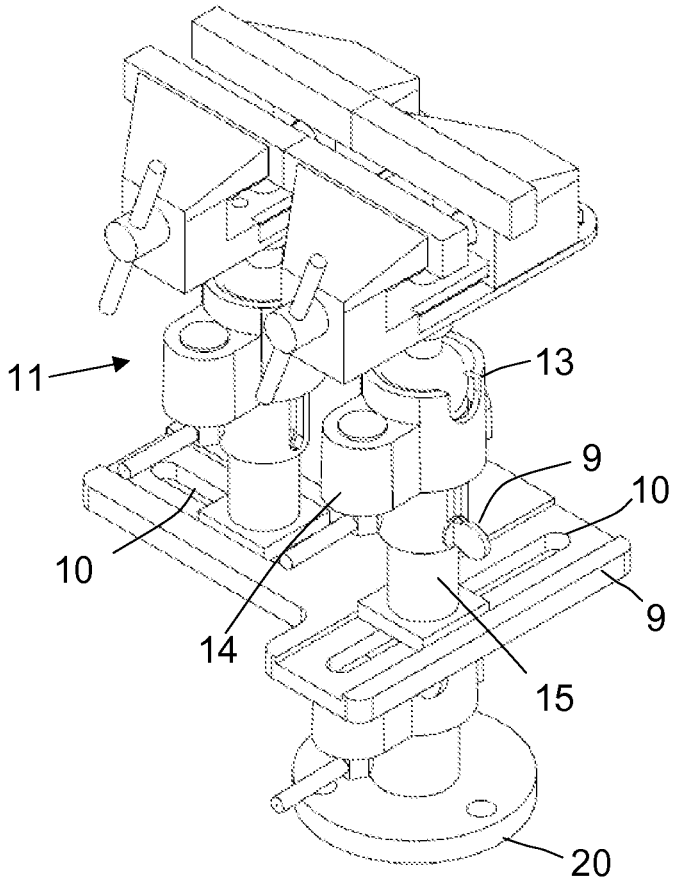
FIG. 4 shows the two vise system with an alternate mount that include a base plate permanently bolted down, similar to current vise designs.

Yet another version of the invention is illustrated in FIG. 4. In this version, the mounting clamp 17 of FIG. 1 is replaced by a bolt down base plate 20.

Figure 5:
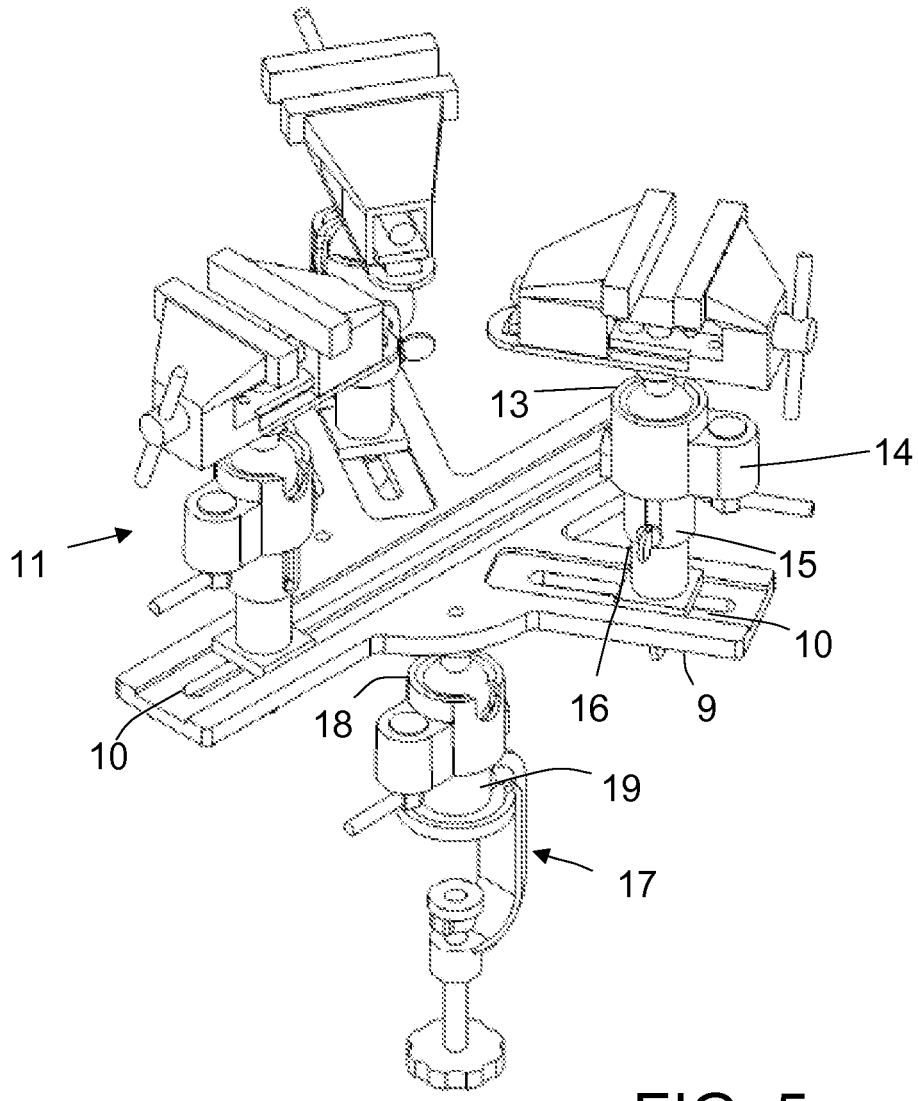
FIG. 5 shows a three-vise system wherein the vises are equipped with swivels and height adjustment poles.

Yet one more version of this invention is shown in FIG. 5. This version includes three vise heads 1 instead of two. The slots 10 in the supporting platform 9 are oriented at 120 degrees from each other. The supporting platform may also be attached to the clamp 17 by means of a swivel 18 and telescoping pole system 19 to provide more flexibility if needed.

Figure 6:
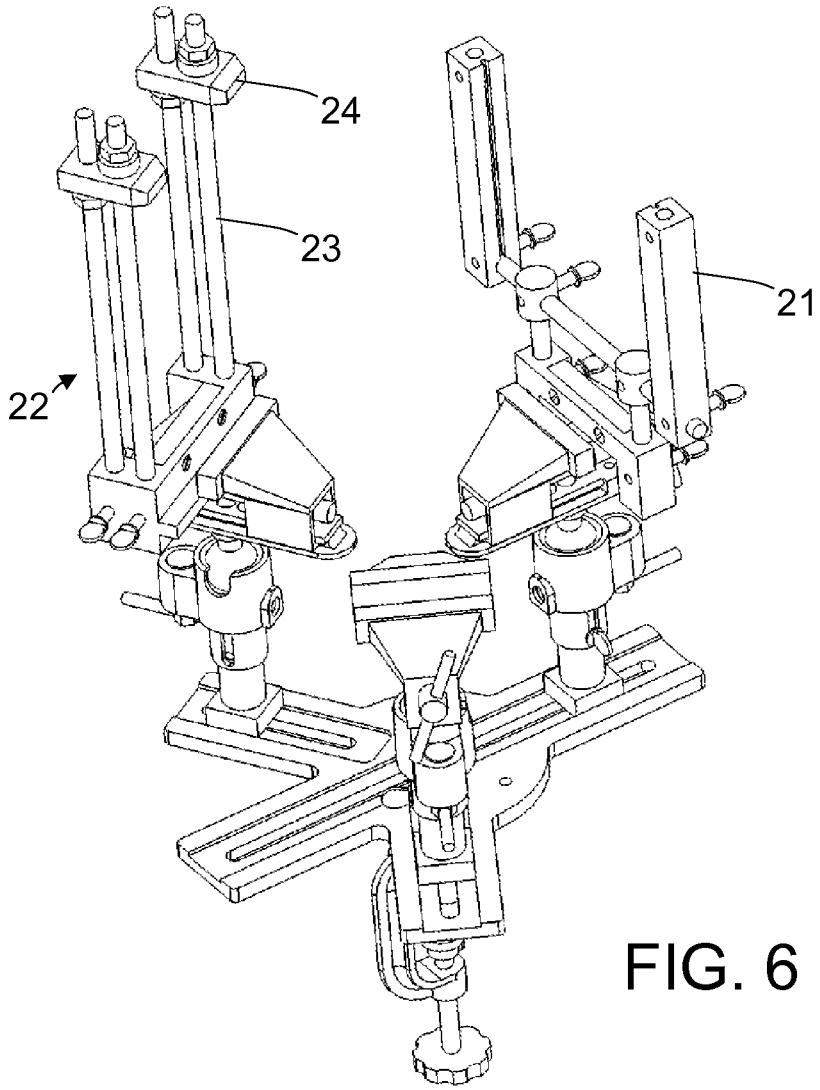
FIG. 6 shows a three vise system holding special purpose secondary clamps specially designed to hold specially shaped objects such as printed circuit boards, or to hold objects too large to fit within the vise head.

Another variation of the invention is shown in FIG. 6. A vise head can be used in conjunction with a secondary clamp. The drawing shows a first secondary clamp 21 configured to hold printed circuit boards, small panels or any other similar shaped objects.

FIG. 6 also shows another secondary clamp 22 comprising of four fully threaded rods 23 of varying lengths which support secondary clamping jaws 24. This attachment is used to hold objects which would normally be considered too large or bulky for the size of the vise head, further increasing its capabilities.

While the above description contains much specificity, the reader should not construe this as limitations on the scope of the invention, but merely as examples of preferred embodiments thereof. Those skilled in the art will envision many other possible variations within its scope. Accordingly, the reader is requested to determine the scope of the invention by the appended claims and their legal equivalents, and not by the examples which have been given.

NUMERAL INDEX

1 Vise head
2 Vise head base
3 Track on vise base
4 Fixed jaw on vise head
5 Movable jaw on vise head
7 Tightening axle
8 Screw on axle
9 Positioning platform
10 Slots in positioning platform
11 Anchor at the bottom of vise head
12 Tightening screws on vise head anchor
13 Swivel mechanism for each vise head
14 Tightening screw for swivel
15 Telescoping pole mechanism for each vise head
16 Tightening screw for pole
17 Clamp for multiple vise head system
18 Swivel between clamp and supporting platform
19 Telescoping pole between clamp and supporting platform
20 Bolt-down base plate
21 Printed circuit board holder
22 Large object holder
23 Threaded rods
24 Secondary jaws

I claim:

1. A multiple vise system comprising:

a) At least two vise heads, each vise head comprising two jaws and a tightening screw, b) a supporting structure configured to support each said vise head and adjust the position of each said vise head according to at least two degrees of freedom with respect to each other, c) wherein said supporting structure comprises at least one track and at least one slot, each said at least one track being parallel to each said at least one slot, thus forming a track-slot pair, each said track-slot pair configured to slidably support one vise head, d) said at least two track slot pairs being oriented at an angle and not parallel, with respect to each other.

2. The multiple vise system of claim 1 wherein said degrees of freedom are linear.

3. The multiple vise system of claim 1 also comprising a clamp supporting said vise system to a work bench, said clamp configured to be tightened by means of a screw.

4. The multiple vise system of claim 1 also comprising a base plate supporting said vise system to a work bench, said base plate configured to be bolted down to a work bench.

5. The multiple vise system of claim 1 wherein at least one said vise head is attached to said supporting structure by a means comprising a swivel.

6. The multiple vise system of claim 1 wherein at least one said vise head is attached to said supporting structure by a means comprising a telescoping pole.

7. The multiple vise system of claim 1 wherein at least one said vise head is attached to said supporting structure by a means comprising a telescoping pole and a swivel, said telescoping pole and said swivel being equipped with tightening screws.

8. The multiple vise system of claim 1 comprising two track-slot pairs supporting two vise heads, said track slot pairs being oriented perpendicularly to each other.

9. The multiple vise system of claim 1 comprising three track-slot pairs and three vise heads, said track slot pairs being oriented at 120 degrees with respect to each other.

10. The multiple vise system of claim 1 wherein one of said at least one vise head holds an adjustable clamp configured to hold printed circuit boards.

11. The multiple vise system of claim 1 wherein said at least one vise head holds a secondary clamping vise.

12. The multiple vise system of claim 11 wherein said secondary clamping vise comprises four threaded rods.

* * * * *